United States Patent [19]

Fierro

[11] Patent Number: 5,056,821

[45] Date of Patent: Oct. 15, 1991

[54] ILLUMINATED SKI POLE AND METHOD

[76] Inventor: Nicholas S. Fierro, 100 Knapp Pl., Englewood, N.J. 07631

[21] Appl. No.: 382,843

[22] Filed: Jul. 20, 1989

[51] Int. Cl.[5] ..... A63C 17/26

[52] U.S. Cl. ..... 280/816; 280/819; 362/102

[58] Field of Search ..... 280/816, 821, 819; 362/102; 135/66

[56] References Cited

U.S. PATENT DOCUMENTS

| | | | |
|---|---|---|---|
| 2,362,131 | 11/1944 | Haggart, Jr. | 362/102 |
| 2,435,650 | 2/1948 | Greene | 362/102 |
| 2,597,172 | 5/1952 | Parker | 362/102 |
| 3,336,469 | 8/1967 | Barnes, Sr. et al. | 362/102 |
| 4,023,817 | 5/1977 | Hah et al. | 280/816 |
| 4,064,429 | 12/1977 | Boehm | 362/102 |
| 4,129,311 | 12/1978 | Hodgson et al. | 280/816 |
| 4,206,445 | 6/1980 | Steinhauer | 280/819 |
| 4,208,701 | 6/1980 | Schock | 362/102 |
| 4,236,544 | 12/1980 | Osaka | 135/66 |
| 4,513,692 | 4/1985 | Kuhnsman et al. | 362/102 |
| 4,678,450 | 7/1987 | Scolari et al. | 362/102 |

FOREIGN PATENT DOCUMENTS

| | | | |
|---|---|---|---|
| 629740 | 7/1963 | Belgium | 362/102 |

*Primary Examiner*—Andres Kashnikow
*Assistant Examiner*—Richard Camby
*Attorney, Agent, or Firm*—Ralph W. Selitto, Jr.

[57] ABSTRACT

An illuminated ski pole has a light dispersing shaft and/or a light dispersing fiber optic element affixed to its shaft. The light dispersing shaft and the light dispersing fiber optic element have external surfaces which are modified by, for example, roughening, micro-faceting, micro-ridging or micro-grooving so as to enhance the dispersion of light from the shaft and/or the fiber optic element, whereby substantially the entire ski pole can be illuminated.

21 Claims, 2 Drawing Sheets

ILLUMINATED SKI POLE AND METHOD

FIELD OF THE INVENTION

The present invention relates to ski poles and, more particularly, to ski poles that are adapted to be illuminated.

BACKGROUND OF THE INVENTION

Illuminated ski poles have been proposed to reduce some of the risks of accident to skiers, especially those encountered when skiing under poor lighting conditions. In general, such ski poles are only illuminated over a relatively small portion of their overall length, and therefore their illumination capabilities are limited.

U.S. Pat. No. 4,023,817 to Lah discloses a ski pole having a shaft with a hollowed upper portion which houses a light source. A small portion of the shaft adjacent to the light source is made of a translucent or transparent material. Because the remainder of the shaft is made from a conventional, opaque material, the ski pole has limited light-transmitting capability. Additionally, the need to hollow out the shaft to accommodate the light source necessarily weakens the overall strength of the pole.

U.S. Pat. No. 4,129,311 to Hodgson discloses a ski pole which is illuminated by a light source received within the shaft of the pole. Because the shaft must be hollowed out to receive the light source, its strength is impaired. Also, because the light is dispersed from a relatively small portion of the shaft, the pole is only partially illuminated.

In U.S. Pat. No. 4,206,445 to Steinhauer a light source is installed in the handle portion of a ski pole. Because the light is dispersed from the handle only, the entire shaft remains non-illuminated.

In my prior U.S. patent application Ser. No. 920,379, filed Oct. 20, 1986, now abandoned, there was disclosed an illuminated ski pole having a single light source installed in the handle portion of the ski pole. In one embodiment, light from the source was transmitted to a solid, translucent shaft which carried the light along its length. A second embodiment included a hollow translucent shaft having longitudinal grooves along which the light was transmitted.

SUMMARY OF THE INVENTION

The present invention relates to a new and improved illuminated ski pole which typically includes a handle, at least one source of light housed in the handle, and a shaft extending from the handle. In accordance with the improvement, light emanating from the source is transmitted to dispersing means, such as a fiber optic element, adapted to disperse the light along substantially the entire length of the shaft, whereby substantially the entire ski pole is illuminated. When the light dispersing means is a fiber optic element, substantial portions of its exterior surface are modified such that the internal reflection of light within the optic element is incomplete at those modified portions and a large amount of the light is outwardly diffracted.

Possible modifications of the surface include molding the element with a plurality of micro-grooves, micro-ridges, or micro-facets, or simply by roughing, etching or otherwise altering the surface contour by mechanical or chemical means. It is also possible to mold the shaft in a manner which causes it to have minute air bubbles which cause a decrease in the internal reflection of the light carried by the shaft and therefore a corresponding increase in light dispersion.

In one embodiment, the shaft itself is a modified fiber optic element having a surface conformation which has micro-ridges along substantially the entire length of the shaft. The shaft is inserted into and attached to a cavity in the handle so that an upper end of the shaft is adjacent to the light source.

In an alternate embodiment, the light is transmitted and dispersed by one or more modified fiber optic elements having sufficient flexibility to be wrapped around the shaft. These fiber optic elements are optically coupled to the light source in the handle and, exiting the handle, are affixed along the length of the shaft in either a linear or spiralling manner. In this way, the light emanating from the source can be disseminated and diffracted along the entire length of the shaft or a substantial portion thereof.

Other embodiments of the present invention include varying the number and color of the light sources, combining the two embodiments described above, and using a shaft with an elliptical cross-section. The embodiments of the invention lend themselves to uses such as decreasing the risk of collision, signalling for aid and improving the aesthetic value of illuminated ski poles without diminishing the strength of the ski pole shaft.

BRIEF DESCRIPTION OF THE DRAWINGS

For a more complete understanding of the present invention, reference may be had to the following detailed description of three exemplary embodiments considered in conjunction with the accompanying drawings, in which.

DETAILED DESCRIPTION OF THE EXEMPLARY EMBODIMENTS

Figure 1:
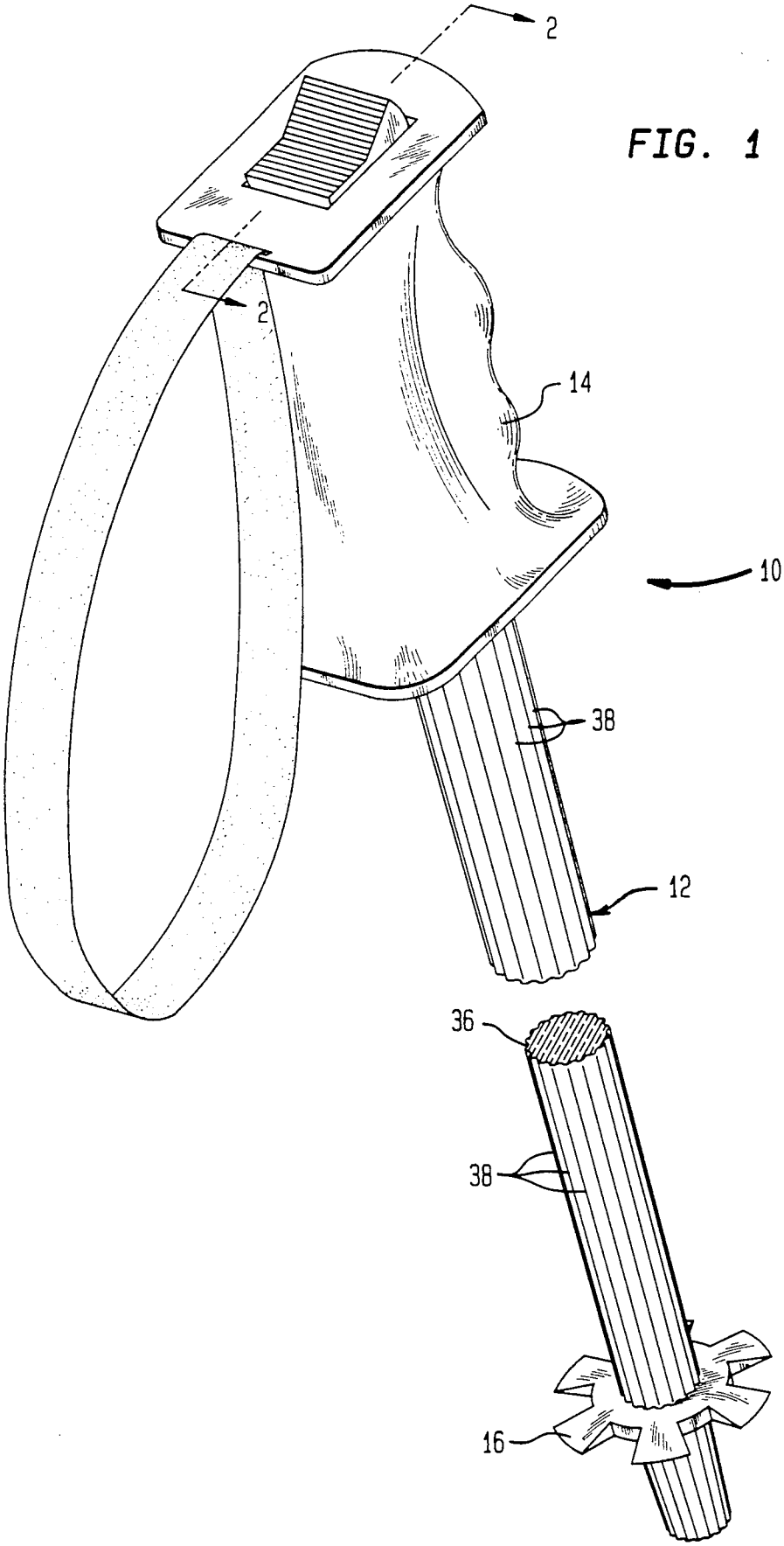
FIG. 1 is a perspective view of an illuminated ski pole constructed in accordance with one exemplary embodiment of the present invention, a portion of the ski pole being broken away to facilitate consideration and discussion.
Figure 2:
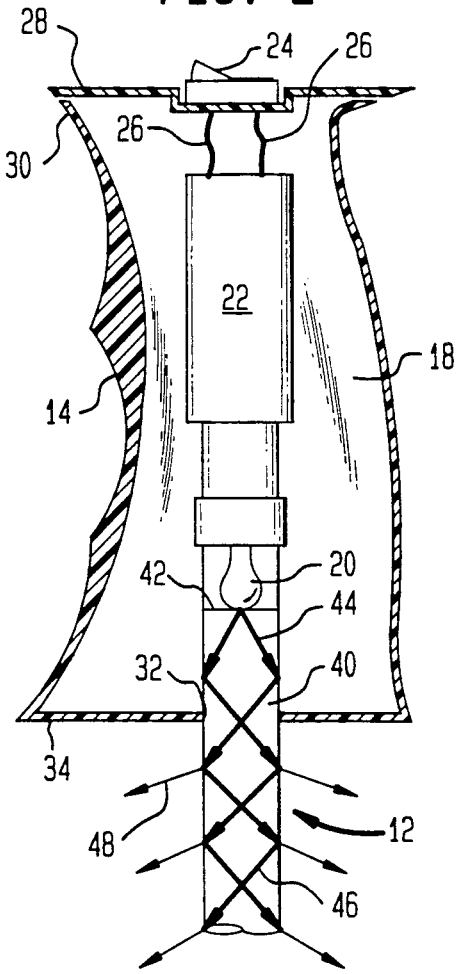
FIG. 2 is a longitudinal cross-sectional view, taken along section line 2—2 of FIG. 1 and looking in the direction of the arrows, of a portion of the ski pole illustrated in FIG. 1.

Referring to FIGS. 1 and 2, a ski pole 10 includes a shaft 12, a handle 14 and a basket 16. The handle 14, which is preferably constructed of a relatively rigid rubber or plastic material, has a cavity 18 of sufficient size to house a light bulb 20, a power source 22, a manually-operable "on/off" switch 24 and electrical conductors 26 for connecting the power source 22, and hence the light bulb 20, to the switch 24. The switch 24 is mounted on a removable cover 28 located at an upper end 30 of the handle 14. An aperture 32 formed in a lower end 34 of the handle 14 receives the shaft 12.

The shaft 12 is a solid cylinder constructed of a suitable transparent or translucent material (e.g., Lexan). An outer surface 36 of the shaft 12 is provided with molded micro-ridges 38, which begin just below the lower end 34 of the handle 14 and run longitudinally along substantially the entire length of the shaft 12. An upper portion 40 of the shaft 12 is secured in proximity to the light bulb 20 in such a manner that light emitted from the light bulb 20 shines directly downward onto a face 42 of the upper portion 40 of the shaft 12.

Snell's Law teaches that a transparent or translucent substance of appropriate dimension and refractive index will conduct, by internal reflection, a light ray transmitted into it. Substantially all the light is internally reflected unless it is incident upon a surface at an angle greater than the critical angle characteristic of the material. By modifying a surface of a light transmitting substance, for example by roughening, micro-faceting, micro-ridging or micro-grooving, the angles of all or most of the rays incident upon the modified portion are changed with the result that some of them will be incident at angles greater than the critical angle. Such a modification allows the escape and dispersion of some of the light at the modified surface, the remainder of the light being internally reflected onward along the shaft. Thus, modifying the outer surface of the shaft results in incomplete internal reflection and enhanced dispersion of a portion of the light along the modified surface.

In order to illuminate the ski pole 10, a user manually moves the switch 24 to its "on" position, thereby actuating the light bulb 20. A light ray 44 emitted from the light bulb 20 is transmitted into the face 42 of the upper portion 40 of the shaft 12. In accordance with Snell's Law, the light ray 44 is internally reflected along the shaft 12 until it is incident upon one of the micro-ridges 38 at an angle which exceeds the critical angle characteristic of the material from which the shaft 12 is made. Upon such incidence, the light ray 44 is split into an inwardly reflected portion 46 and an outwardly refracted portion 48, which causes the ski pole 10 to be illuminated.

Figure 3:
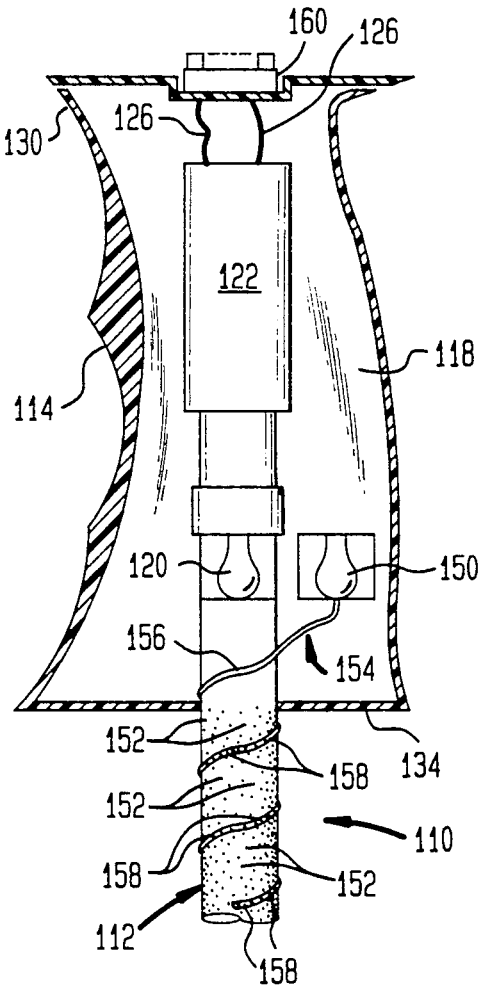
FIG. 3 is a cross-sectional view, which is similar to FIG. 2, of a ski pole constructed in accordance with another exemplary embodiment of the present invention.
Figure 4:
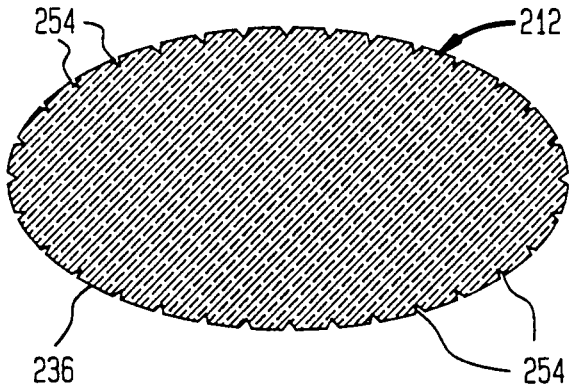
FIG. 4 is a lateral cross-sectional view showing a shaft of a ski pole constructed in accordance with yet another exemplary embodiment of the present invention.

Two other exemplary embodiments of an illuminated ski pole constructed in accordance with the present invention are illustrated in FIGS. 3 and 4. Elements of the embodiments illustrated in FIGS. 3 and 4 which correspond to the elements described above with respect to FIGS. 1 and 2 have been designated by corresponding reference numerals increased by one hundred and two hundred, respectively. The embodiments of FIGS. 3 and 4 operate in the same manner as the embodiment of FIGS. 1 and 2 unless it is otherwise stated.

Referring to FIG. 3, there is shown a ski pole 110 having a handle 114 which is provided with a cavity 118 of sufficient size to house a light bulb 120 and a light bulb 150, which is optically isolated from the light bulb 120. The light bulb 120 is optically coupled to a shaft 112, which is modified so as to include a multiplicity of micro-facets 152 adapted to function in the same manner as the micro-ridges 38. The light bulb 150 is optically coupled to a fiber optic element 154 having an external surface 156, which is modified so as to include micro-facets 158 adapted to function in the same manner as the micro-ridges 38. The fiber optic element 154 has a flexibility sufficient to permit it to be helically wrapped around the shaft 112, the fiber optic element 154 passing through a notch (not shown) formed in a lower end 134 of the handle 114 and extending along substantially the entire length of the shaft 112 or just a portion thereof. A four-position switch 160 can be manually operated by a user of the ski pole 110 such that (i) the light bulb 120 is actuated when the light bulb 150 is deactuated, (ii) the light bulb 150 is actuated when the light bulb 120 is deactuated, or (iii) the light bulbs 120 and 150 are actuated simultaneously.

Referring now to in FIG. 4, a shaft 212 has an elliptical, rather than cylindrical, cross-sectional shape which imparts increased strength to the shaft 212. Furthermore, incomplete internal reflection of light transmitted along the shaft 212 is accomplished by micro-grooves 254 etched or molded into an outer surface 236 of the shaft 212.

It will be understood that the embodiments described herein are merely exemplary and that a person skilled in the art may make many variations and modifications without departing from the spirit and scope of the invention. For instance, the light bulbs 20, 120 and 150 may be of various different colors. Additionally, the shaft 112 could be made of a conventional opaque material, rather than of a light transmitting material such as a fiber optic element. All such modifications and variations are intended to be included within the scope of the invention as defined in the appended claims.

I claim:

1. In a ski pole which includes a handle, at least one source of light housed in the handle, and a shaft extending from the handle, the improvement wherein the shaft is made from a solid, translucent, elastically resilient element having an unsmooth exterior surface extending along substantially the entire length of the shaft so as to disperse light from the light source along substantially the entire length of the shaft, whereby substantially the entire ski pole is illuminated.

2. The improved ski pole of claim 1, wherein the shaft is a cylinder.

3. The improved ski pole of claim 2, wherein the exterior surface of the shaft is multi-faceted to thereby enhance the dispersion of the light from the shaft.

4. The improved ski pole of claim 2, wherein the exterior surface of the shaft includes a multiplicity of raised micro-ridges cresting and declining radially about the shaft, a crest of each of the ridges extending in a direction substantially parallel to the shaft along substantially the entire length thereof to thereby enhance the dispersion of the light from the shaft.

5. The improved ski pole of claim 2, wherein the exterior surface of the shaft is scored by a multiplicity of elongated linear micro-grooves disposed radially around the shaft and extending in a direction substantially parallel to the shaft along substantially the entire length thereof to thereby enhance the dispersion of the light from the shaft.

6. The improved ski pole of claim 2, wherein the shaft has a lateral cross-sectional shape which is generally circular.

7. The improved ski pole of claim 1, wherein the shaft has a lateral cross-sectional shape which is generally elliptical.

8. In a ski pole which includes a handle, at least one source of light housed in the handle, and a shaft extending from the handle, the improvement wherein the shaft is made from a solid, elastically resilient element on which is mounted at least one fiber optic element extending from the source of light along substantially the entire length of the shaft and having a capacity to disperse light from the light source in a direction perpendicular to the shaft along substantially the entire length thereof.

9. The improved ski pole of claim 8, wherein said at least one fiber optic element is helically wound about the shaft.

10. The improved ski pole of claim 9, wherein the shaft is made from an opaque material.

11. The improved ski pole of claim 8, wherein the shaft itself disperses light, whereby substantially the entire ski pole is illuminated.

12. The improved ski pole of claim 11, wherein the shaft is a solid cylinder of translucent material having an unsmooth exterior surface.

13. The improved ski pole of claim 11, wherein the exterior surface of the shaft is multi-faceted to thereby enhance the dispersion of the light from the shaft.

14. The improved ski pole of claim 11, wherein the exterior surface of the shaft includes a multiplicity of raised micro-ridges cresting and declining radially about the shaft, a crest of each of the ridges extending in a direction substantially parallel to the shaft along substantially the entire length thereof to thereby enhance the dispersion of the light from the shaft.

15. The improved ski pole of claim 11, wherein the exterior surface of the shaft is scored by a multiplicity of elongated linear micro-grooves disposed radially around the shaft and extending in a direction substantially parallel to the shaft along substantially the entire length thereof to thereby enhance the dispersion of the light from the shaft.

16. The improved ski pole of claim 11, wherein the shaft has a lateral cross-sectional shape which is generally circular.

17. The improved ski pole of claim 11, wherein the shaft has a lateral cross-sectional shape which is generally elliptical.

18. The improved ski pole of claim 11, wherein the handle includes a plurality of sources of light, one source being positioned so as to transmit light emanating therefrom to the shaft and another source being positioned so as to transmit light emanating therefrom to said at least one fiber optic element.

19. The improved ski pole of claim 18, wherein said one source of light emits light of a first color and wherein said another source of light emits light of a second color which is different from said first color.

20. In an a illuminated ski pole which includes a handle and a shaft extending from the handle, the improvement comprising dispersing means for dispersing light along substantially the entire length of the shaft, said dispersing means including the shaft, at least one fiber optic element extending from the handle along substantially the entire length of the shaft, a plurality of sources of light disposed in the handle, one source being positioned so as to transmit light of a first color emanating therefrom to the shaft and another source being positioned so as to transmit light of a second and different color emanating therefrom to said at least one fiber optic element, and controlling means for controlling the actuation and deactuation of said one source of light and said another source of light such that (i) said one source of light can be actuated when said another source of light is deactuated, (ii) said another source of light can be actuated when said one source of light is deactuated and (iii) said one source of light can be actuated when said another source of light is actuated.

21. The improved ski pole of claim 20, wherein said controlling means includes a manually-operable switch positioned on the handle and connected to said one source of light and said another source of light.

* * * * *